United States Patent [19]

Fulkerson

[11] Patent Number: 4,557,878

[45] Date of Patent: Dec. 10, 1985

[54] SPLASH-TYPE FILL

[75] Inventor: Robert D. Fulkerson, Raytown, Mo.

[73] Assignee: Munters Corporation, Ft. Myers, Fla.

[21] Appl. No.: 612,921

[22] Filed: May 22, 1984

[51] Int. Cl.[4] ..... B01F 3/04

[52] U.S. Cl. ..... 261/111; 261/DIG. 11

[58] Field of Search ..... 261/111, DIG. 11, DIG. 72

[56] References Cited

U.S. PATENT DOCUMENTS

| | | | |
|---|---|---|---|
| 2,356,653 | 8/1944 | Cox | 261/111 |
| 2,971,750 | 2/1961 | Boling | 261/111 |
| 3,378,239 | 4/1968 | Engalitcheff, Jr. et al. | 261/DIG. 11 |
| 3,389,895 | 6/1968 | De Flon | 261/111 |
| 3,643,931 | 2/1972 | Henning et al. | 261/111 |
| 3,647,191 | 3/1972 | Fordyce | 261/111 |
| 3,879,502 | 4/1975 | Furlong et al. | 261/111 |
| 3,969,447 | 7/1976 | Glitsch et al. | 261/111 |
| 4,133,851 | 1/1979 | Ovard | 261/111 |
| 4,439,378 | 3/1984 | Ovard | 261/111 |

FOREIGN PATENT DOCUMENTS

| | | | |
|---|---|---|---|
| 1965230 | 7/1970 | Fed. Rep. of Germany | 261/111 |

*Primary Examiner*—Richard L. Chiesa

[57] ABSTRACT

A splash bar fill assembly for a splash-type cooling tower includes a plurality of splash bars, each of which includes a one piece elongated member having a pair of upwardly converging leg members joined together to form an apex, and a vertical supporting rib member extending downwardly from the apex. The fill assembly also includes a wire mesh support system for the splash bars. The wire mesh supports the splash bars within the cooling tower in an arrangement of successive rows. Each row of the arrangement has its splash bars arranged in parallel and in spaced apart relationship. The splash bars of one row are disposed angularly to those of an adjacent row and are arranged parallel to and vertically offset from those of an alternate row. The wire mesh is formed from a plurality of vertical and horizontal wires which are joined together at their points of intersection. The joints formed at the intersection of the wires are adjacent the lowermost ends of the leg members of the splash bars with the ends of the leg members in abutting contact with the joints.

10 Claims, 9 Drawing Figures

SPLASH-TYPE FILL

BACKGROUND OF THE INVENTION

1. Field Of The Invention

This invention relates to cooling tower fill assemblies and particularly to an improved splash-type fill bar construction for use in cooling tower installations.

Splash-type cooling towers are well known in the art. They are generally characterized by streams of water falling on fill bars arranged in a geometrical pattern within a cavity beneath a water distributing system. The water falling by means of gravity splashes upon contact with the fill bars to form smaller droplets in a moving air stream.

In general, such cooling towers include a large housing through the side of which air is admitted and from the top of which the air is exhausted by suitable means such as exhaust fans. The water to be cooled is distributed throughout the housing from the upper surface of the housing by means such as the distributing pan. The water falls by gravity to a basin at the lower portion of the housing and is cooled during its descent by its intimate contact with air moving through the housing. During its descent, the water is broken into smaller droplets by splashing upon fill bars which are interspersed throughout the cavity defined by the interior of the housing. The splash fill bars thus break up the downward flow of water and provide surface area for commingling the water and air passing through the housing to promote cooling. As is well known, such cooling towers may be of the cross-flow type in which the air flows transversely to the descent of the water or of the counter-flow type in which the air travels in the direction opposite to the descent of the water. The improved splash bar and splash fill assembly of a cooling tower in accordance with the present invention are applicable to both counter-flow and cross-flow towers and are, in general, applicable to all types of towers in which the water is to be cooled or in which water provides the cooling medium.

More particularly, cooling towers employing splash-type fill may be characterized by the fact that streams of water fall upon fill bars arranged in a geometrical pattern wherein the water splashes upon contact and forms smaller droplets in a moving air stream. As the drops fall downwardly, some of the drops coalesce and impinge on lower splash bars, repeating the cycle. Exposure of the relatively warm drops of water to the moving air stream causes the water to cool and partially evaporate. Interrupting the fall of the individual drops by coalescing, splashing on the fill bars, or sub-dividing into new drops to expose more surface area, promotes rapid cooling.

2. Descripton of the Prior Art

Splash-type fill bars have long been utilized in the art as an effective fill material for heat exchanging cooling towers. They have in the past been made from wood, such as redwood, but are today more commonly made from solid, extruded plastic material, sheet metal, aluminum or the like. These materials avoid the disadvantages of wooden splash bars, such as deterioration by rotting and increased possibility of fire hazard.

The cross-sectional configuration of many types of splash fill bars used today vary considerably from application to application. Three examples of splash bars having different configurations are disclosed in Deflon, U.S. Pat. No. 3,389,895; Fordyce, U.S. Pat. No. 3,647,191; and Ovard, U.S Pat. No. 4,133,851.

Fill assemblies comprising splash bars of a particular profile are chosen in accordance with the job requirements. Of course, all configurations should promote optimal cooling and uniformity of liquid dispersement. Moreover, manufacturers of splash-type fill material strive to obtain improved cooling performance and structural strength using less material.

OBJECTS AND SUMMARY OF THE INVENTION

It is an object of the present invention to provide an improved splash-type fill assembly which is arranged to maximize water dispersement while minimizing resistance to the flowing air through the cooling tower.

It is an additional object of the present invention to provide a splash-type fill assembly which increases the overall cooling efficiency and economy of operation of the cooling tower.

It is a further object of the present invention to describe a splash-type fill assembly which can be reliably supported and maintained in selected positions within the cooling tower.

It is a still further object of the present invention to provide an improved splash bar for use in a splash-type fill assembly which is simple and inexpensive to construct and easy to install in a fill assembly structure.

It is another object of the present invention to provide a splash bar with improved structural strength and rigidity over its full longitudinal length.

It is yet another object of the present invention to provide a new splash bar which is configured to be easily installed and secured to a supporting system within the cooling tower.

In accordance with the present invention, a splash bar fill assembly for a splash-type cooling tower includes a plurality of splash bars, formed as one piece elongated members. Each splash bar has a cross-sectional configuration which defines a pair of sloped, upwardly converging leg members joined together to form an apex, and a vertical supporting rib member extending downwardly from the apex.

The fill assembly also includes a support system for the splash bars. The system allows the splash bars to be supported within the cooling tower in an arrangement of successive rows. Each row has its splash bars arranged in parallel spaced apart relationship. The splash bars of one row are disposed angularly to those of immediately adjacent rows above and below it. The splash bars in alternate rows are arranged parallel to and vertically offset from those in the alternate rows above and below it. This arrangement ensures that water gravitating from a precedingly higher row of splash bars will always strike a splash bar of a lower row. Such an arrangement provides optimal water dispersement.

The supporting system includes a wire grid or mesh positioned generally transversely of the splash bars. The grid includes a plurality of vertical and horizontal wires which are joined together at their points of intersection. The joints formed at the intersection of the horizontal and vertical wires are adjacent the lowermost ends of the leg members of the splash bars with the ends of the leg members in abutting contact with the joints. This contact helps maintain the structural integrity of the splash bars within the assembly.

The splash-type fill bar of the present invention may include a U-shaped retainer clip which is adapted to be fitted onto the lowermost end of the vertical rib member while simultaneously engaging the horizontal wires of the grid. The retainer clip thus secures the fill bar to the grid in a selected position within the tower.

These and other objects, features and advantages of this invention will be apparent in the following detailed description of the illustrative embodiments thereof, which is to be read in connection with the accompanying drawings.

DETAILED DESCRIPTION OF THE PREFERRED EMBODIMENTS

Figure 1:
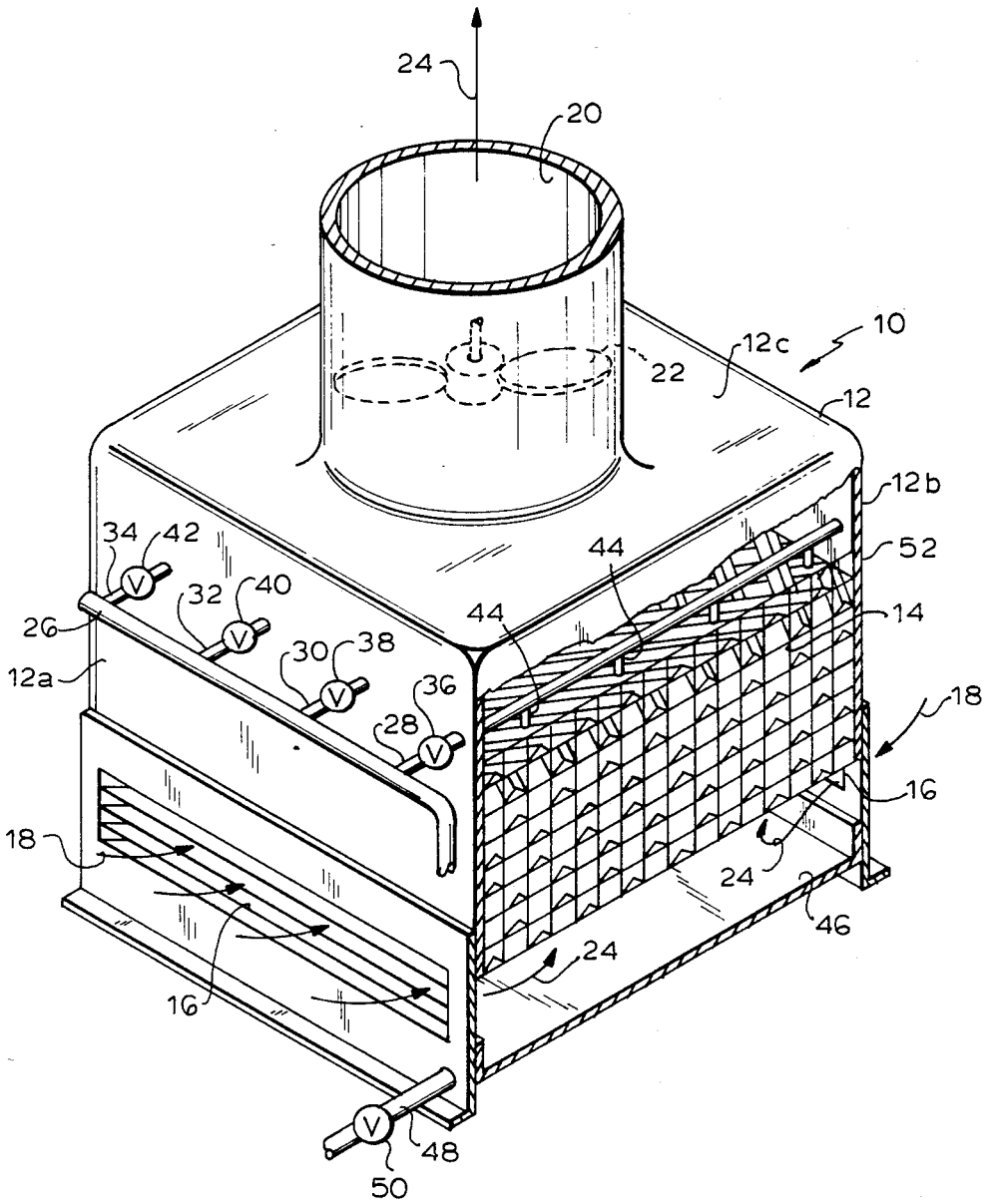
FIG. 1 is an environmental perspective view of a heat exchanging cooling tower with its housing partially broken away to expose the splash-type fill assembly of the present invention.

Referring now to the drawings in detail and initially to FIG. 1 thereof, it will be seen that a splash-type fill assembly, constructed in accordance with the present invention, is disposed within a cooling tower 10. The cooling tower 10 comprises a casing 12 which houses the splash fill assembly 14 of the present invention. Casing 12 has opposite sides 12*a*, 12*b* which include lateral openings 16 for atmospheric air that enters the casing in the direction of the arrows 18. The top 12*c* of casing 12 has a discharge opening 20 within which an impeller or fan 22 is mounted. The fan is driven by a conventional motor (not shown) and draws atmospheric air into the casing through the lateral openings 16. This air flows in a mainly vertical direction upwards through splash fill assembly 14 to opening 20, as indicated by the arrows 24.

While the tower shown in FIG. 1 is a counter-flow tower, the splash fill assembly of the present invention is quite adaptable for use in a cooling tower of cross-flow configuration where, for example, intake and discharge openings are positioned at opposite ends of the splash bar elements comprising the splash fill.

A water distributing system is positioned above the splash fill assembly. This system includes a main pipe or header 26 and branch pipes 28, 30, 32 and 34. The branch pipes are equipped with valves 36, 38, 40 and 42 to control the flow of the water supplied to the fill assembly. The branch pipes may open into a trough (not shown) positioned above the splash fill assembly 14 and having a perforated bottom for downward flow of the water into the splash fill. Alternatively, the branch pipes may include spaced apart distribution nozzles 44 for providing gravitating water to the fill assembly.

The cooled water which has passed through the splash fill assembly is collected in a sump 46 at the bottom of the cooling tower and is discharged through a pipe 48 controlled by a valve 50 to the place of utilization. Upon renewed heating at the place of utilization the water is returned through the main pipe 26 to the cooling tower to be supplied to the splash-type fill assembly 14.

In the cooling tower, the water from nozzles 44 flows in a downward direction through the splash-type fill 14 and there meets the upwardly advancing air. Exposure of the water to the air cools the water and the air takes up moisture until it is saturated. The water gravitating through the fill impinges the splash bars in the succeeding rows in the fill assembly 14 and breaks into smaller water droplets. As a result, more surface area of the water is exposed to the air resulting in more efficient and rapid cooling.

The splash bar elements which comprise the fill assembly 14 are preferably extruded from a polyvinyl chloride material, although other materials such as sheet metal, stainless steel or aluminum are suitable for use. Extrusion advantageously allows the splash bars to be formed as one piece elongated members, with each of its component parts being integrally joined together. This improves the structural rigidity of the splash bar elements and, of course, economizes on its manufacture.

Figure 5:
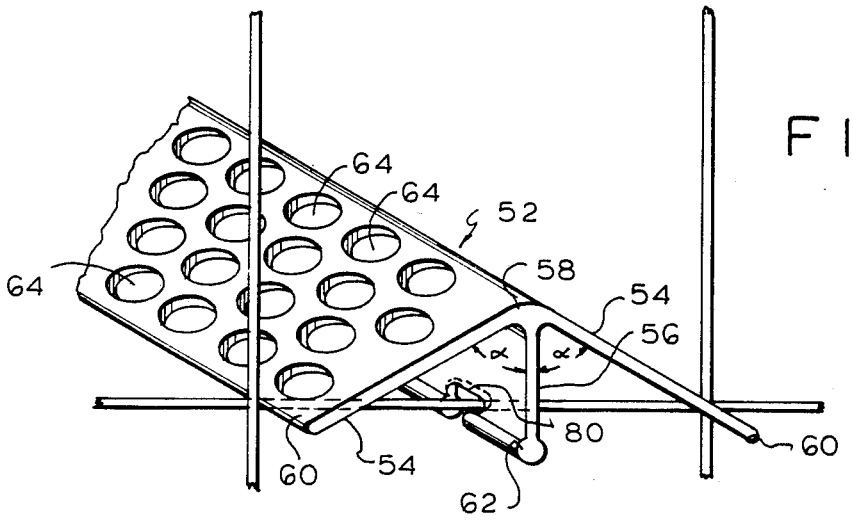
FIG. 5 is a perspective view of one embodiment of a splash bar element and hanger grid.

Referring now to FIG. 5 of the drawings, an individual elongated splash bar 52 is illustrated. The splash bar has a cross-sectional configuration including a pair of leg members 54 and a supporting rib member 56. Leg members 54 are sloped and upwardly converge to join together to form an apex 58 in the elongate member. Rib member 56 is vertically disposed and extends downwardly from apex 58 between legs 54. It functions primarily to support the central span of the splash bar and, as will be described, secondarily to secure the splash bar to the wire hanger support system.

The acute angle $\alpha$ formed between leg members 54 and vertical supporting rib member 56 is preferably 60°. This angle is selected based upon a number of factors. If the leg members 54 are too steeply sloped, i.e., the angle $\alpha$ is made much less than 60°, water gravitating from above will roll off the leg members without splashing into smaller water droplets. This would be undesirable because the water droplets would merge into larger rather than smaller droplets. If the cross-sectional configuration of the splash fill is made too shallow, i.e., the angle $\alpha$ is made much greater than 60°, the smaller droplets formed from the splash that occurs when a water droplet strikes the fill bar will not be deflected beyond the edges 60 of the leg members 54. The splashing water droplets would then reform on the same splash bar into the same size water droplet and simply drip off edges 60. Furthermore, leg members 54 have been found to be sufficiently reinforced by the vertical rib member 56 when disposed at an angle of 60° to the rib member. This configuration also saves considerable material which would have been used on the length of each leg member to reinforce the splash bar element 52.

Vertical supporting rib member 56 may include a bulbous formation or bead 62 at its lowermost edge. This bead provides further reinforcement for the rib member.

Splash bar 52 preferably includes perforations 64 formed in leg members 54. Perforations 64 preferably have a diameter of about ⅜ inch and are spaced apart about ½ inch from center to center. The perforations 64 are arranged in rows from the edges 60 of the leg members 54 almost to the apex 58, with the perforations of one row offset about halfway between those of the next adjacent row. This provides a denser hole pattern.

It has been found that this perforation configuration provides a preferred balance between splash cooling surface area and aperture area for fragmenting water globules. The diameter of the perforations 64, preferably ⅜ inch, prevents the formation of a water film over the surface of the perforations. Each splash bar 52 is preferably first formed by extrusion and then punched by a die to form the ⅜ inch perforations in the leg members.

Figure 9:
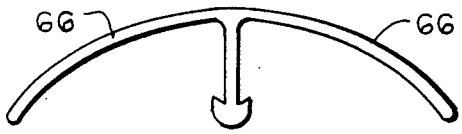
FIG. 9 is an end view of an alternative splash bar element constructed in accordance with the present invention.

As is seen in FIG. 5, the cross-sectional profile of splash bar elements 52 attributed by the leg members 54 is in the shape of an inverted "V". An alternative fill bar shape is shown in FIG. 9. In that embodiment leg members 66 are joined together in the same way as that described for the embodiment illustrated in FIG. 5, except that the leg members 66 are curved to give the fill bar illustrated in FIG. 9 an overall arcuate shape.

Figure 2:
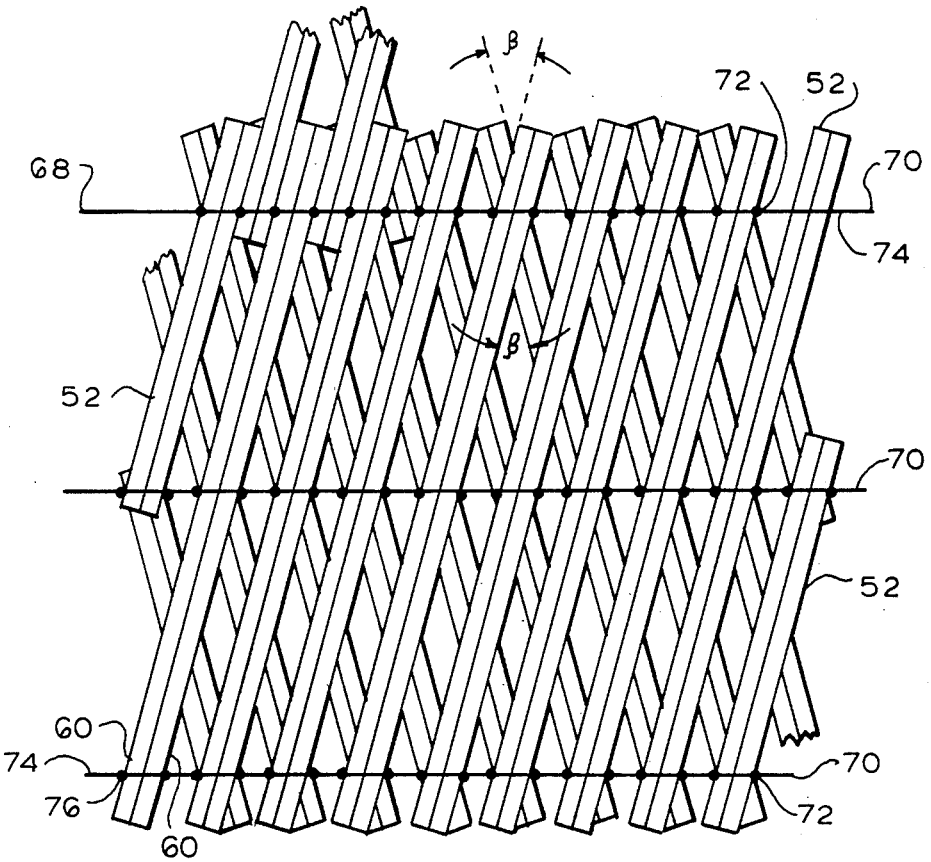
FIG. 2 is a plan view of the fill assembly with the splash fill arranged in a preferred pattern.
Figure 3:
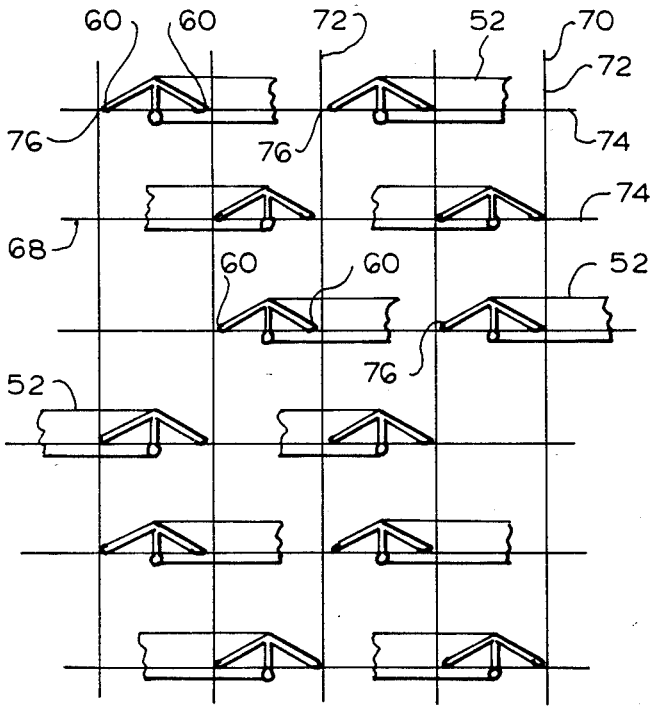
FIG. 3 is an end view of the fill assembly shown in FIG. 2.
Figure 4:
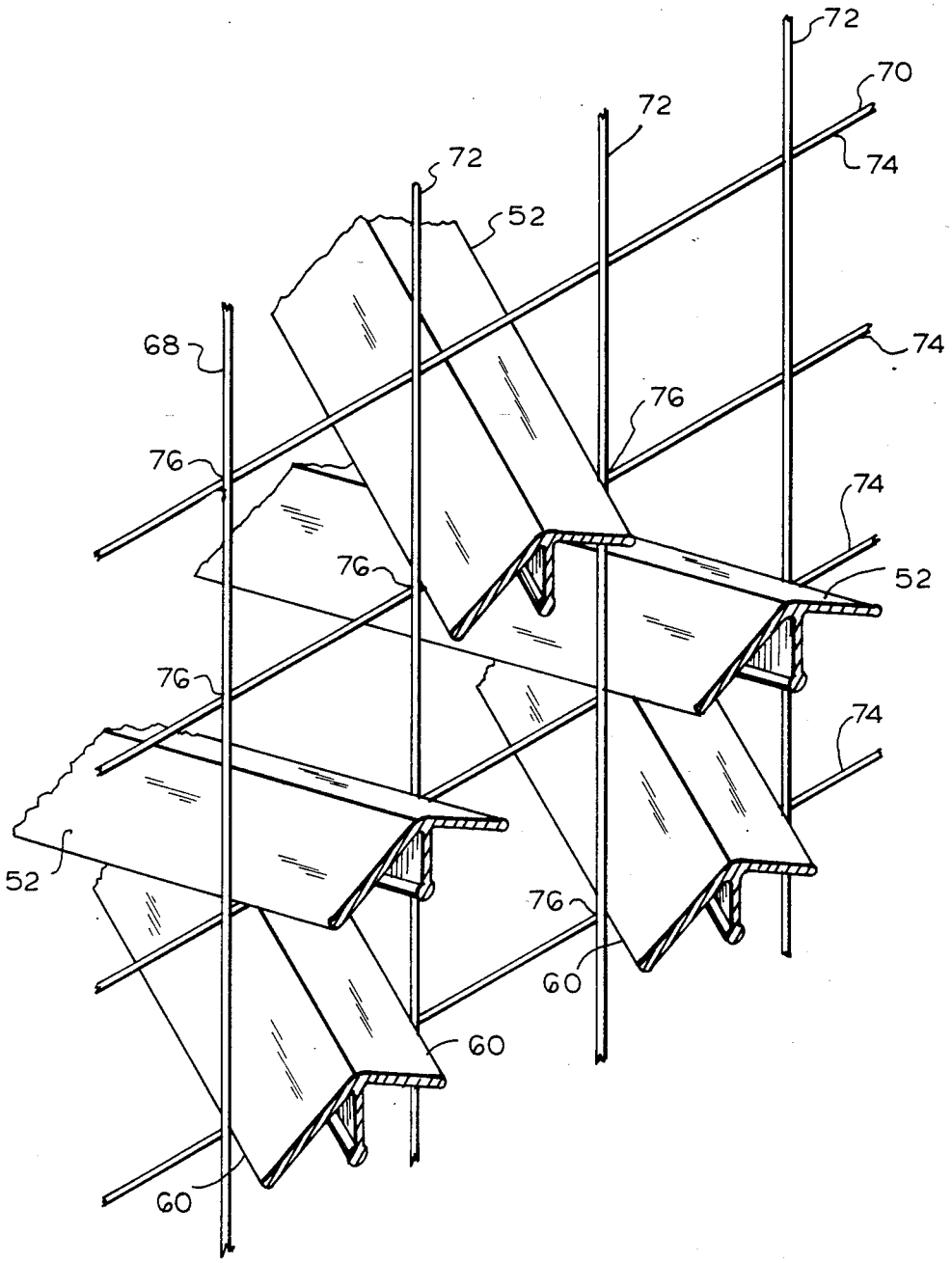
FIG. 4 is an enlarged isometric view of the fill pattern shown in FIGS. 2 and 3.

As illustrated in FIGS. 2 through 4 of the drawing, the splash type fill assembly 14 includes a plurality of splash bar elements 52, as previously described, arranged in successive vertical rows within the cooling tower. The assembly also includes a supporting system 68 for the splash bars. The support system consists of a plurality of wire hanger grids 70 suspended within the cooling tower and spaced apart a distance of about three feet.

Each grid 70 extends in a plane generally transversely of the splash bars 52. The grids include a plurality of vertical wires 72 for laterally spacing the splash bars and for supporting a tension load caused by the weight of the bars and the gravitating water. The grids also include a plurality of horizontal wires 74 for supporting the splash bars. Each of the vertical and horizontal wires 72, 74 are linked together by welding, or in any other convenient manner, to define joints 76 at their points of intersection. The joints 76 are spaced at predetermined distances so that they are adjacent the lowermost ends of each leg member of the splash bars and are in abutting contact with the lower edges 60 of the leg members. Thus, the wire grid adds lateral support to the splash bars which is especially helpful when the bars are under heavy water loading conditions.

The splash bars are preferably about 4 inches in width and, therefore, to ensure that each joint 76 of the grid abuts an end of each leg member, the vertical wires 72 of the grid should be spaced apart about the same distance. As will be described in greater detail later, the distance between adjacent vertical wires 72 in each grid may be made slightly greater than the width of the splash bar to compensate for the preferred angle at which the splash bars are suspended within the cooling tower.

The preferred length of splash bar elements 52 is about 6 feet. It is, therefore, preferred if 3 wire hanger grids 70, spaced about 3 feet apart, are used to support the splash bar elements over their entire length. For a 6 foot length of splash bar, 3 grids spaced in the manner described adequately distribute the tension load of the gravitating water over the entire length of the fill bars without the fill bars collapsing under the stress of the water load.

As mentioned previously, the fill assembly comprises a plurality of splash bars 52 arranged in successive rows vertically within the cooling tower. The splash bars of each row are arranged parallel to one another and in spaced apart relationship. It is preferred that the distance between adjacent splash bars in each row measured from adjacent edges 60 of the leg members does not exceed the width of the splash bar. Thus, as seen in FIGS. 2 and 4 a splash bar is positioned in every other space defined by vertical wires 72 for each row.

Splash bars 52 are also arranged in a pattern which prevents the water droplets from falling entirely through the fill assembly without striking any of the splash bar elements. Thus, the splash bars of any one particular row are disposed angularly to those of an adjacent row. Splash bars of adjacent rows are normally offset at an angle $\beta$ of 30° but the orientation can vary from between 0° to 90°, although 20° to 70° is the preferred range for the angle $\beta$.

Furthermore, the fill assembly is preferably arranged so that the splash bar elements 52 of any one row are parallel to and vertically offset from those of an alternate row. The splash bars of alternate rows are preferably offset a distance of about the width of a splash bar to catcn any water droplets falling between adjacent, spaced apart splash bars of any one row.

Splash bars 52 of adjacent rows are angled to one another to provide a circuitous path to the flow of air through the cooling tower. Also, criss-crossing the fill bars allows an even greater water loading capability throughout the fill assembly. The arrangement provides an even distribution of water and air and the particular orientation of the splash bars within the fill assembly provides optimal water cooling by maximizing the splashing and formation of smaller water droplets.

Referring again to FIG. 5, splash bars 52 are fitted snugly between the 4 inch spaced wire mesh. The joints 76 formed at the intersections of the horizontal and vertical wires 74, 72 abut the lowermost edges 60 of the leg members, as described previously. Thus, the grid is used to provide rigidity to the system and to prevent the splash bars from shifting within the assembly.

In the embodiment illustrated in FIG. 5, splash bars 52 are secured to the wire grid by hooking them onto the horizontal wires 74. For this purpose, an L-shaped notch 80 is provided in the lower portion of the vertical support rib member 56. Each splash bar may thus be secured to the wire grid by engaging the horizontal wires 74 within the L-shaped notch 80 formed in the rib members, as shown.

Figure 6:
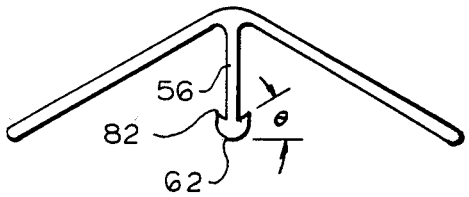
FIG. 6 is an end view of an alternative embodiment of a splash bar element constructed in accordance with the present invention.
Figure 8:
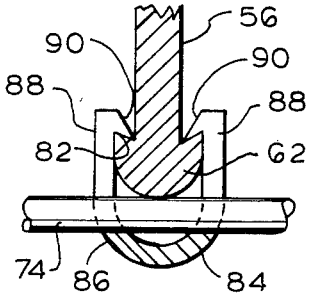
FIG. 8 is a sectional view taken along lines 8—8 of FIG. 7.
Figure 7:
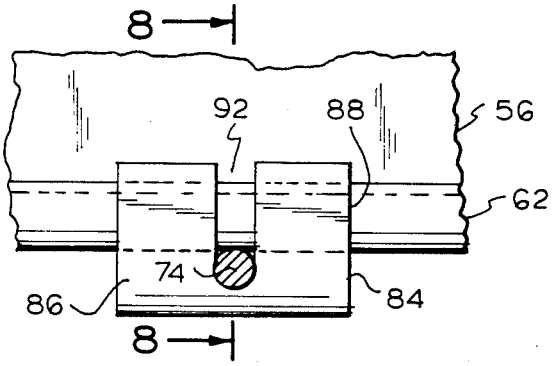
FIG. 7 is a side view of a retainer clip which may be used in conjunction with the splash bar element of FIG. 6 to secure the same to the hanger grid.

An alternative means for securing the splash bars to the wire hanger grid is illustrated in FIGS. 6 through 8 of the drawings. In this embodiment, bulbous formation 62 on the end of rib 56 is recessed at its upper portion where it joins the rib, to provide the profile shown in FIG. 6. The recesses 82 in bulbous formation 62 define seats for a retainer clip 84 used to secure the splash bar element to the wire grid.

Retainer clip 84 includes a U-shaped body 86 having a pair of upstanding resilient arm members 88. Preferably, each arm member 88 includes inwardly disposed barbs 90 which function to engage in recessed seats 82. A slot 92 is formed in each arm member 88 to receive the horizontal wire 74 of the grid. Thus, retainer clip 84 is adapted to simultaneously engage the horizontal wire of the grid and the bulbous formation 62 of the rib member, which fits between the arm members 88 of the clip.

The barbs 90 of the arm members lockingly engage in recessed seats 82 to secure the fill bar to the grid.

Retainer clip 84 is preferably dimensioned to be ¾ inch in length and ⅜ inch in height. Slot 92, formed in the arms of the clip, is ⅛ inch wide but, of course, this dimension varies in accordance with the diameter of the horizontal wires of the grid. Slot 92 is centered in the longitudinal length of the retainer clip. Barbs 90 formed in the arm members are preferably ⅛ inch in width.

The vertical support rib member and the leg members of splash bars 52 are each, preferably, 3/32 inch in thickness. The apex 58 of the fill bar, defined by the converging leg members, can be rounded to a 1 inch radius. The bulbous formation 62 is preferably ¼ inch in diameter and if recessed seats 82 are formed, as illustrated in FIG. 6 of the drawings, the formation is recessed on each side of the rib member an angle $\theta$ of about 30° from the horizontal.

As mentioned earlier, the length of each fill bar is preferably chosen to be 6 feet. This length facilitates handling and installation of the fill assembly within the cooling tower. Several assemblies of 6 foot splash bars may be combined by having the ends of their splash bar elements overlap in a side-by-side relationship by sharing a common wire hanger grid, as illustrated in plan in FIG. 2. Because the splash bars in each row are spaced apart a distance of about the width of one splash bar, i.e. between alternate pairs of vertical wires, there is a vacant space, and thus sufficient room, between the splash bars on the same grid to position the ends of the splash bars in a corresponding row of an adjacent fill assembly. The splash bars in corresponding rows of adjacent assemblies sharing a common grid extend in the same longitudinal direction. Thus, each row of splash bars of one assembly may be continued by joining it with a corresponding row of an adjacent assembly until the combined splash fill covers the entire cross-sectional area of the cooling tower. Additional splash bars may be suspended from the wire hanger grids along the side walls of the cooling tower to cover open areas along the walls not covered by the angularly disposed splash bars of the fill assemblies.

The splash bar constructed in accordance with the present invention optimizes the water cooling capability of the splash fill assembly. The profile of the splash bar and the interaction of the supporting grid with the leg members of the splash bar provides the fill assembly with increased structural strength and rigidity thereby allowing the fill assembly to be used under greater water loading conditions. The capability of the splash bars to be easily manufactured by extrustion makes it economically attractive in view of other prior art splash-type fill assemblies. The circuitous path of the flow of air provided by the angular disposition of the splash bar elements within the fill assembly ensures maximum air/water contact and optimal cooling efficiency.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. A splash bar fill assembly for a splash-type cooling tower, which comprises:

a plurality of splash bars, each splash bar including an elongated member having a pair of upwardly converging leg members joined together to form an apex in the elongate member, and a vertical supporting rib member extending downwardly from the apex of the elongate member; and means for supporting the splash bars within the cooling tower in an arrangement of successive rows, the splash bars of a respective row of the arrangement being arranged in parallel and in spaced apart relationship, each row having splash bars disposed angularly to those of an adjacent row and situated parallel to and vertically offset from those of an alternate row;

wherein the supporting means includes at least one grid extending transversely of the splash bars, the grid having a plurality of vertical wires for laterally spacing the splash bars and for supporting a tension load, and a plurality of horizontal wires for supporting the splash bars, said vertical wires being spaced apart by a dimension at least sufficient to permit insertion between any two vertical wires of a splash bar, with the vertical supporting rib member thereof supported on a horizontal wire.

2. A splash bar fill assembly as defined in claim 1 wherein the splash bars of one row are disposed at an angle of between about 20° and 70° to those of an adjacent row above or below it.

3. A splash-type fill bar adapted for use in a heat exchanging cooling tower, which comprises an elongate member having a cross-section defined by a pair of upwardly converging leg members joined together to form an apex in the elongate member, a vertical supporting rib member extending downwardly from the apex of the elongate member, and means for securing the fill bar to a support wire, the bar securing means including a U-shaped retainer clip having a pair of upstanding resilient arms, each arm having a slot formed therein for receiving a horizontal support wire, the retainer clip being adapted to simultaneously engage the vertical rib member of the fill bar between the arm members of the clip and the horizontal support wire, thereby securing the fill bar to the support wire in a fixed relationship.

4. A splash-type fill bar as defined in claim 3 wherein the vertical support rib member has a lower free end which includes a bulbous formation formed thereon.

5. A splash-type fill bar adapted for use in a heat exchanging cooling tower, which comprises an elongate member having a cross-section defined by a pair of upwardly converging leg members joined together to form an apex in the elongate member, and a vertical supporting rib member extending downwardly from the apex of the elongate member, wherein the vertical rib member of the fill bar includes a free lower end having a bulbous formation formed thereon, the formation being inwardly recessed adjacent the rib to define a seat for a retainer clip; and a retainer clip for securing the fill bar to a support wire, the retainer clip having a U-shaped body including a pair of upstanding resilient arm members, each arm member including inwardly disposed barbs and having slots formed therein to receive a horizontal support wire, the retainer clip being adapted to simultaneously engage the bulbous formation of the rib member between the arm members of the clip and the horizontal support wire, the clip being retained to the rib member by the barbs of the arm members lockingly engaging the recessed seat formed in the bulbous formation, whereby the fill bar is secured to the horizontal support wire in a selected position within the tower.

6. A splash-type fill bar as defined in claim 3 or 5 wherein the inside angle formed between each leg member and the vertical support rib member is about 60°.

7. A splash-type fill bar as defined in claim 3 or 5 wherein the elongated member is perforated over portions of its leg members, the perforations being of sufficient diameter to prevent water gravitating onto the fill bar from filming across the perforations.

8. A splash-type fill bar as defined in claim 3 or 5 wherein the leg members attribute an inverted V-shape in cross-section to the elongate member.

9. A splash-type fill bar as defined in claim 3 or 5 wherein the leg members attribute an arcuate shape in cross-section to the elongate member.

10. A splash-type fill bar as defined in claim 3 or 5 wherein said vertical rib member has a notch formed in the lower end thereof.

* * * * *